US010099099B2

(12) United States Patent
Lebwohl et al.

(10) Patent No.: US 10,099,099 B2
(45) Date of Patent: Oct. 16, 2018

(54) GOLF ACCESSORIES FOR CLEANING HANDS OR EQUIPMENT

(71) Applicants: Scott Lebwohl, Marlboro, NJ (US); Shaun Goodman, Morganville, NJ (US)

(72) Inventors: Scott Lebwohl, Marlboro, NJ (US); Shaun Goodman, Morganville, NJ (US)

( * ) Notice: Subject to any disclaimer, the term of this patent is extended or adjusted under 35 U.S.C. 154(b) by 773 days.

(21) Appl. No.: 14/471,273

(22) Filed: Aug. 28, 2014

(65) Prior Publication Data

US 2015/0074930 A1 Mar. 19, 2015

Related U.S. Application Data

(60) Provisional application No. 61/871,428, filed on Aug. 29, 2013.

(51) Int. Cl.

| | |
|---|---|
| ***A47L 13/16*** | (2006.01) |
| ***A63B 57/60*** | (2015.01) |
| ***A63B 57/00*** | (2015.01) |
| ***A63B 57/30*** | (2015.01) |

(52) U.S. Cl.

CPC ..... *A63B 57/0087* (2013.01); *A47L 13/16* (2013.01); *A63B 57/353* (2015.10); *A63B 57/60* (2015.10); *A63B 2209/10* (2013.01)

(58) Field of Classification Search

CPC ..... A63B 57/60; A63B 60/36

See application file for complete search history.

(56) References Cited

U.S. PATENT DOCUMENTS

| | | | | |
|---|---|---|---|---|
| 3,760,461 | A | 9/1973 | Wright | |
| 3,777,313 | A | 12/1973 | Bergsten et al. | |
| 4,004,315 | A | 1/1977 | Rials | |
| 4,281,781 | A | 8/1981 | Pope | |
| 4,403,366 | A * | 9/1983 | Lucke | A41D 13/0015 15/209.1 |
| 4,768,236 | A | 9/1988 | Klob | |
| 4,771,502 | A | 9/1988 | Trimble | |
| 5,075,918 | A * | 12/1991 | Zeltner | A47L 13/16 15/114 |
| 5,724,698 | A | 3/1998 | Mondragon | |
| 5,761,761 | A * | 6/1998 | An | A47K 10/02 15/114 |
| 5,771,523 | A * | 6/1998 | Rudolph | A63B 55/408 15/209.1 |
| 5,864,925 | A | 2/1999 | McGee | |

(Continued)

*Primary Examiner* — Randall Chin

(74) *Attorney, Agent, or Firm* — Epstein Drangel LLP; Robert L. Epstein

(57) ABSTRACT

A pocket insert card is received within a pocket of a garment. An absorbent fabric sheet is attached to the card such that the sheet can be situated outside the pocket for cleaning purposes while the card remains in the pocket. The fabric sheet may be elongated and folded in face-to-face portions attached to the card. A hook and loop patch may support an object on the fabric sheet. A holder for a spare golf tee or pencil is provided, as is a retainer for a scorecard. The fabric sheet may be inserted into the pocket or may form the pocket body itself. The fabric sheet may also be used without the pocket, attached directly to the interior of a garment. A double sided snap may be used to mount a ball marker to the fabric sheet.

16 Claims, 12 Drawing Sheets

(56) References Cited

U.S. PATENT DOCUMENTS

| | | | | |
|---|---|---|---|---|
| 6,003,190 | A | 12/1999 | Knudsen | |
| 6,115,872 | A | 9/2000 | Welsh | |
| 6,189,153 | B1 | 2/2001 | Diamond | |
| 6,546,599 | B2 | 4/2003 | Pelt et al. | |
| 6,820,281 | B2 | 11/2004 | Mariland et al. | |
| 7,854,021 | B2 | 12/2010 | Compton et al. | |
| 9,216,342 | B1 * | 12/2015 | Evans ..... | A63B 71/0036 |
| 2003/0019766 | A1 | 1/2003 | Jung | |
| 2004/0149313 | A1 | 8/2004 | Dawson et al. | |
| 2007/0119012 | A1 | 5/2007 | Young et al. | |
| 2011/0314592 | A1 | 12/2011 | Wells-Chubb | |

* cited by examiner

GOLF ACCESSORIES FOR CLEANING HANDS OR EQUIPMENT

CROSS-REFERENCE TO RELATED APPLICATIONS

Priority is claimed on Provisional Patent Application Ser. No. 61/871,428 filed Aug. 29, 2013.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates generally to accessories intended primarily for use in playing the sport of golf and more particularly to accessories for cleaning the hands of a golfer or the equipment used in playing golf.

2. Description of Prior Art Including Information Disclosed Under 37 CFR 1.97 and 1.98

In golf after a particularly dirty shot, for example out of a sand trap, golfers need to wipe their hands and often resort to the use of the seat or other portion of their pants or shorts to do so because of the lack of any readily available alternative. Worse than that, golfers may clean off a dirty ball or the face of a club with their hands and then wipe their hands on their clothes.

Products including towels and sports accessories which may be attached to a garment for use to wipe the hands are generally known in the art. However, none of those known products has a simple inexpensive and light weight structure which attaches easily to the clothes of the user that is readily accessible and easy to use.

BRIEF SUMMARY OF THE INVENTION

The present invention can be provided in a number of different preferred embodiments. One embodiment includes a rigid or semi-rigid pocket insert card attached to an absorbent fabric sheet such as a towel. In use, the card is inserted into a user's pocket, preferably a back pocket, with the fabric sheet hanging outside the pocket. The fabric sheet may be removeably attached to the insert card by means of buttons, snaps or the like. Hook and loop fastener material may be provided on the exposed surface of the fabric sheet to hold an object such as a golf glove. Additionally, a double sided snap may be used to attach the fabric sheet to the insert card to which a ball marker can be attached. A holder may be provided to retain a spare golf tee or a pencil for keeping the golf score. Further, a clear film sheet may be situated adjacent the back of the insert card to provide a holder for a golf score card.

In another embodiment, the fabric sheet is elongated and folded over itself in face-to-face relation to form a double layer of fabric material. The free ends of the sheet are joined at the top by the fasteners which connect to the pocket insert card.

In another embodiment, the fabric sheet material is formed into a freestanding pocket which is sewn into a garment worn by the golfer. When the golfer wants to clean hands or equipment, the fabric pocket is inverted as it is pulled out of the garment and used as a towel.

In another embodiment the top of a fabric sheet is sewn to the seam of the lining of an existing pocket in a garment worn by the golfer. The fabric sheet remains in the pocket when not in use. The fabric sheet can be pulled out of the pocket, while the top remains attached to the pocket seam, when used as a cleaning member.

In another embodiment an absorbent fabric sheet is normally situated within the interior of the clothing and is attached to the interior of the clothing proximate an elongated opening. The sheet is otherwise unattached to the clothing such that the person may move the absorbent fabric sheet through the opening to a position outside of the clothing for use in cleaning the person's hands or golf equipment. A zipper may be provided to close the opening.

Accordingly, the present invention relates to a golf accessory for use by a person wearing a garment including a pocket. The accessory includes a member adapted to be received within the pocket of the garment. A sheet formed of absorbent fabric material is attached to the member. Means are provided for attaching the fabric sheet and the member such that the fabric sheet can be situated outside of the pocket while the member remains in the pocket.

The member includes a generally planar rigid or semi-rigid pocket insert card having a body with rounded corners. The fabric sheet preferably has a generally rectangular shape and is situated in face-to-face relation with the insert card.

The attaching means may include means for removeably or permanently attaching the upper portion of the member and the upper portion of the fabric sheet. The attaching means may include one or more snaps, buttons, or hook and loop material.

The fabric sheet may be made of cotton, microfiber or polyester.

The fabric sheet has an exterior surface and may further include means for removeably attaching an object such as a golf glove to the fabric sheet.

The accessory may also include a means for attaching the ball marker to the accessory.

The accessory may further include means for retaining the score card on the member. The retaining means includes a clear film sheet attached to the back of the member.

The fabric sheet may be elongated and include first and second portions folded in face-to-face relation such that one portion of the fabric sheet aligns with the member.

In another embodiment a garment is provided having a pocket formed of sheets of absorbent fabric material stitched together along the sides and bottom to define an opening along the top. The pocket is stitched to the garment along the top opening with the remainder of the body of the pocket being unattached such that the body of the pocket can be inverted and placed outside the garment for use in cleaning hands or equipment.

In another embodiment a garment is provided including a pocket extending into the interior of the garment. The absorbent fabric sheet is attached to the upper portion of the pocket. The remaining portion of the absorbent fabric sheet is unattached to the garment such that the fabric sheet which is normally situated within the pocket may be moved to a position outside of the pocket proximate the exterior of the garment for use in cleaning hands or equipment.

In another embodiment the absorbent fabric sheet is normally situated within the interior of the clothing and is attached to the interior of the clothing proximate an elongated opening in the clothing. The absorbent fabric sheet is otherwise unattached to the clothing. The person may move the absorbent fabric sheet through the opening to a position outside of the clothing for use in cleaning the person's hands or golf equipment. A zipper may be provided to close the opening.

BRIEF DESCRIPTION OF THE SEVERAL VIEWS OF DRAWINGS

To these and to such other objects that may hereinafter appears, the present invention relates to golf accessories for cleaning hands or equipment as described in detail in the following specification and recited in the annexed claims, taken together with the accompanying drawings, in which like numerals refer to like parts and in which:

Figures 3A, 3B, 3C:
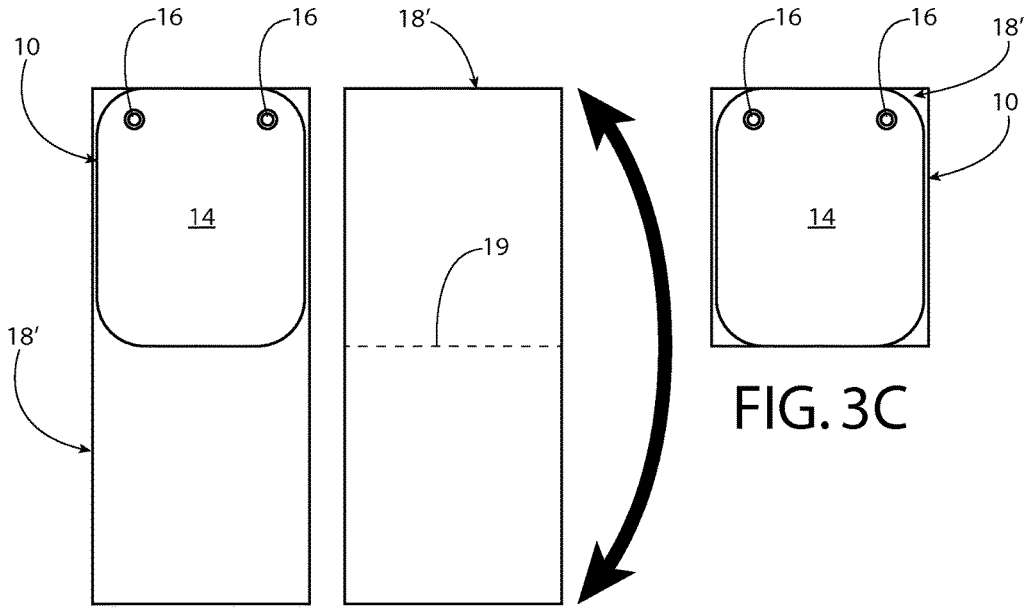
Figure 3D:
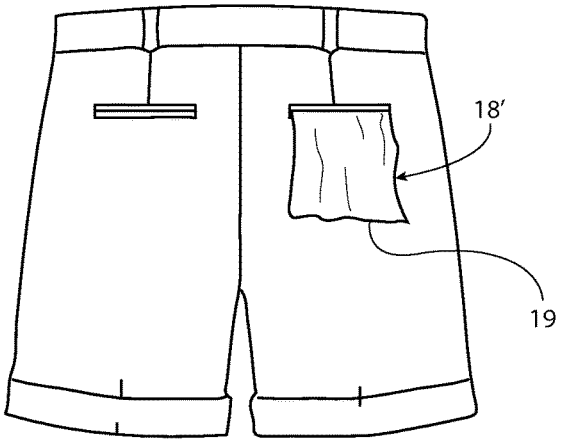
Figure 4:
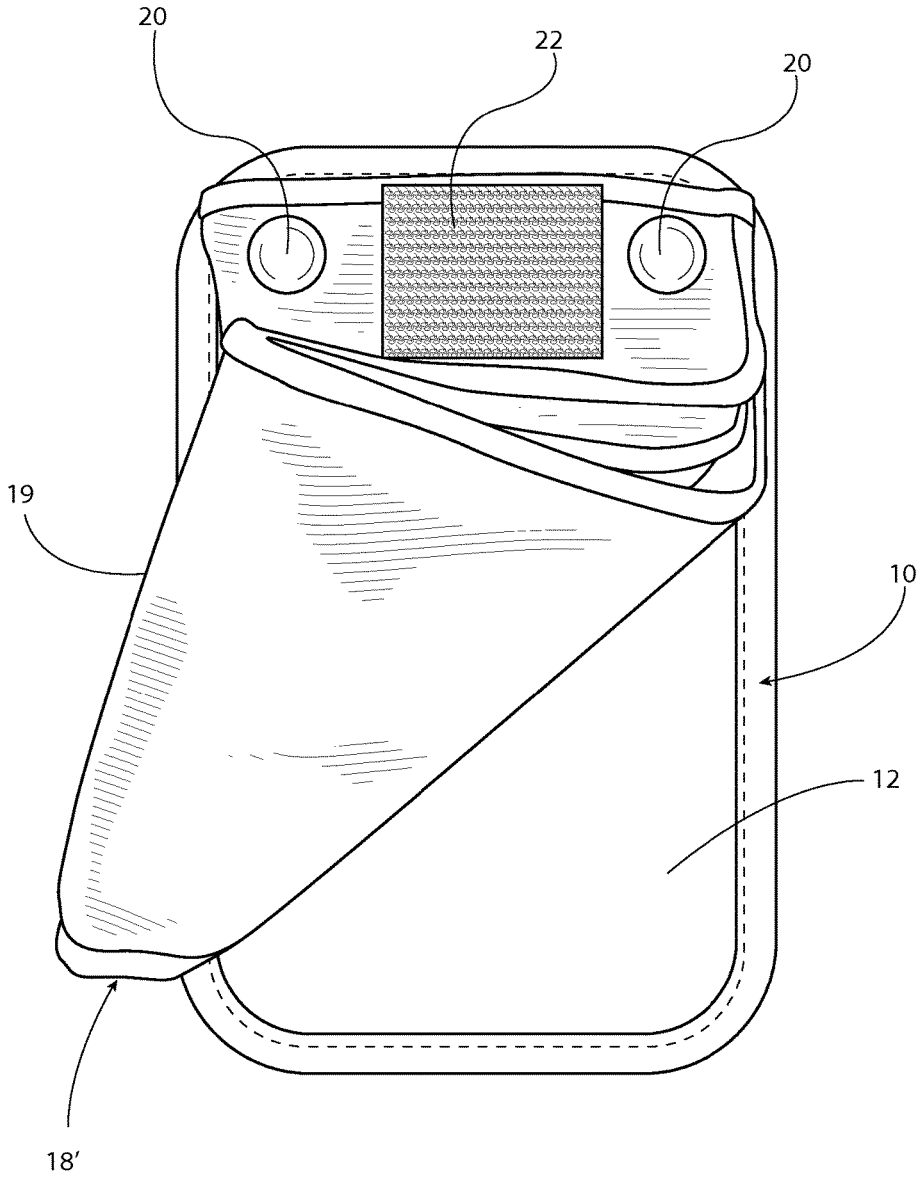
Figure 5:
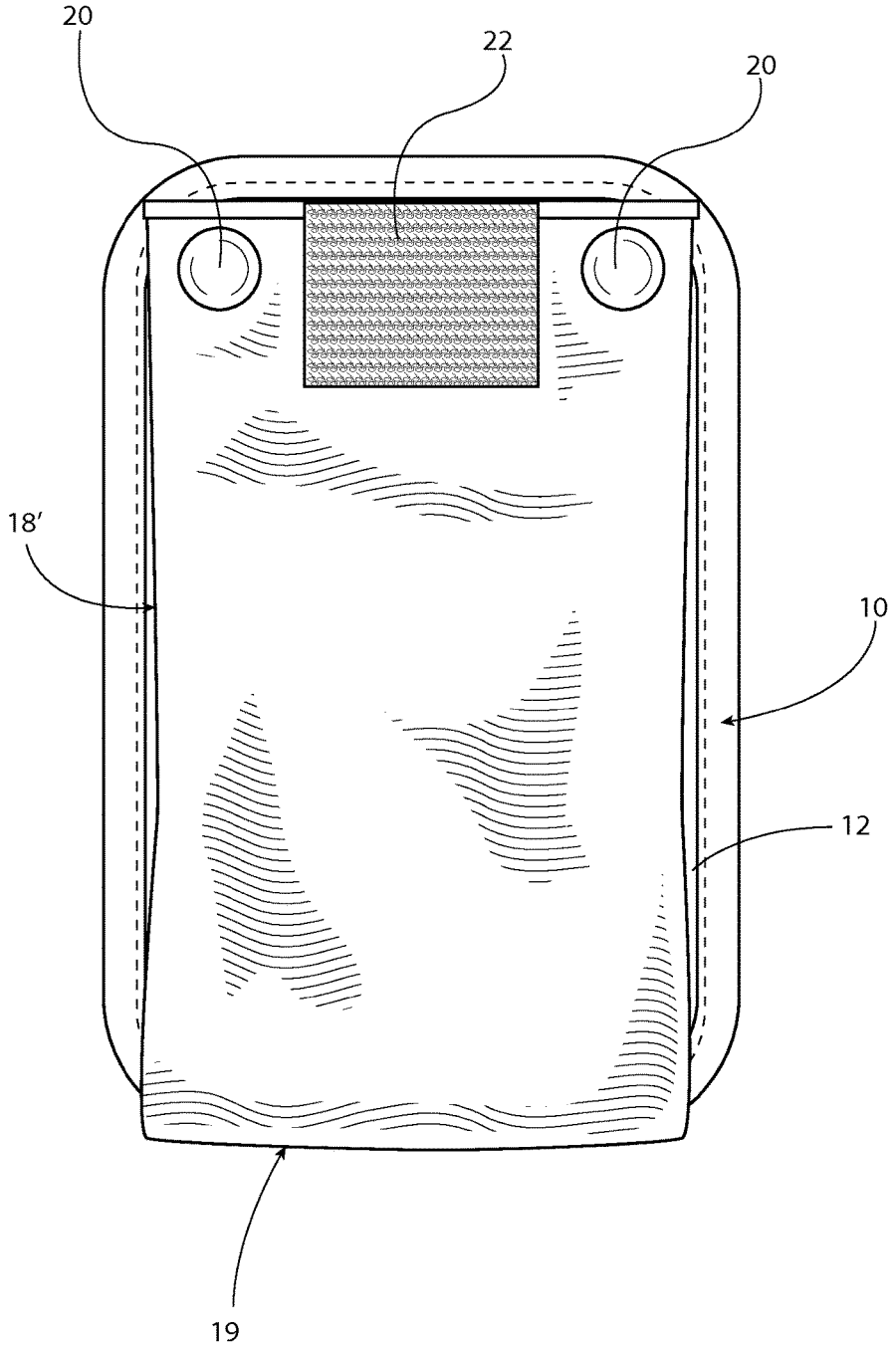
Figure 6:
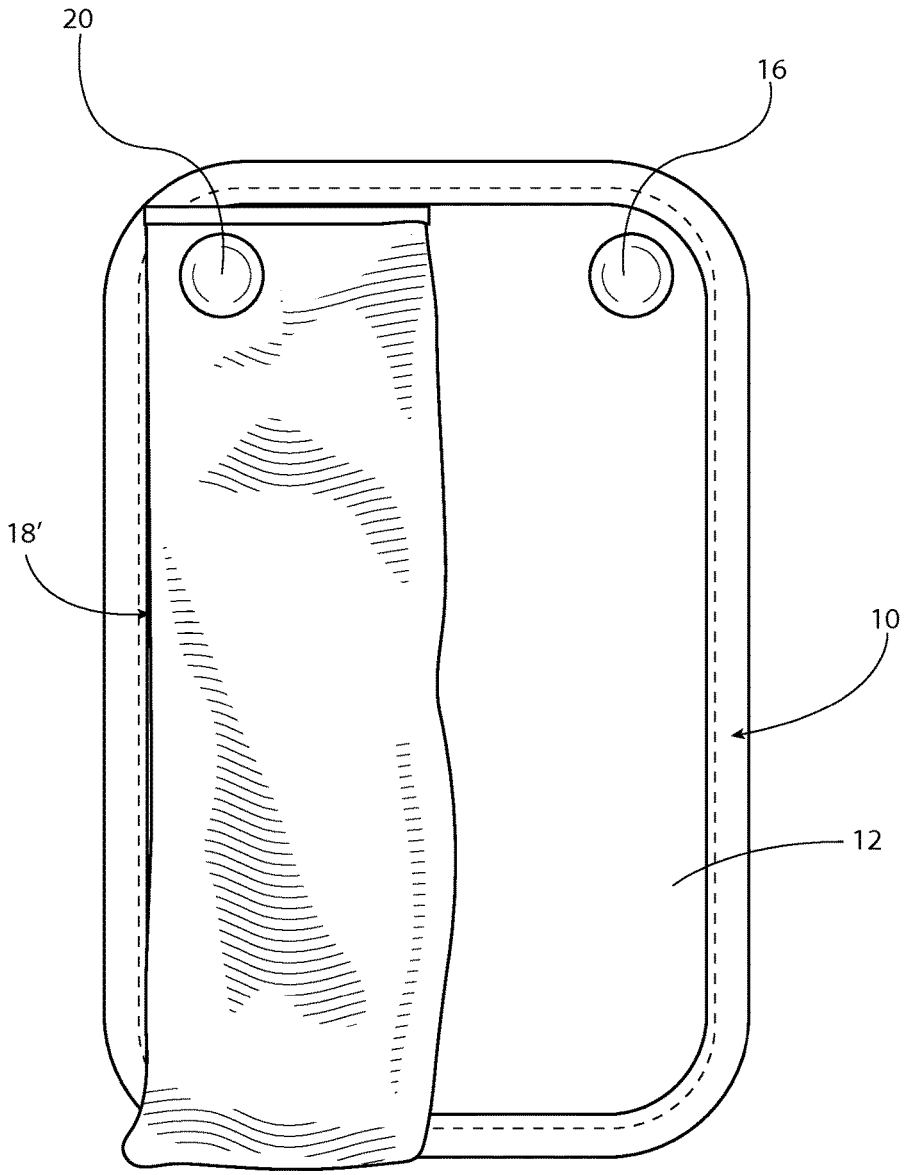
Figure 7:
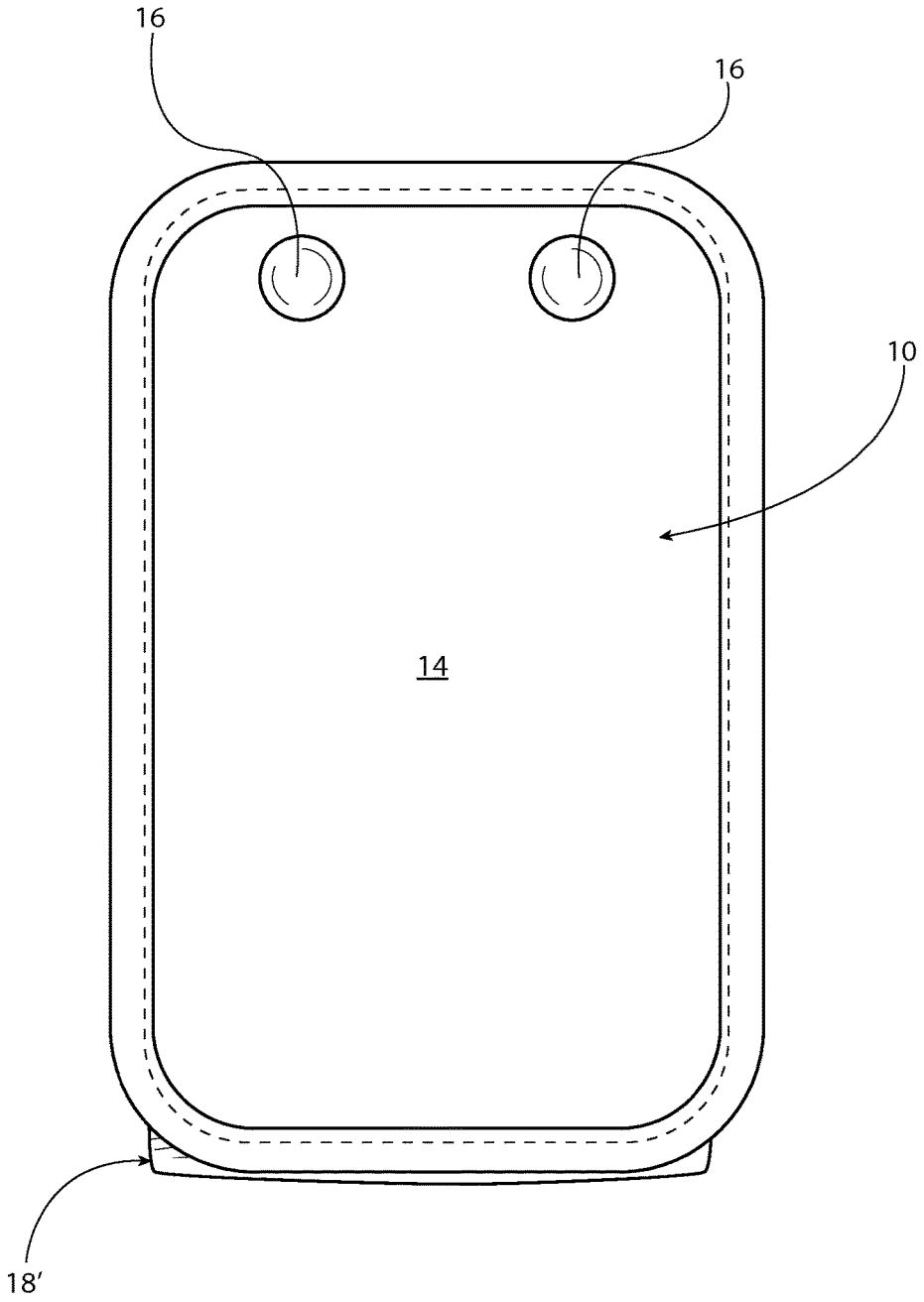
Figure 8A:
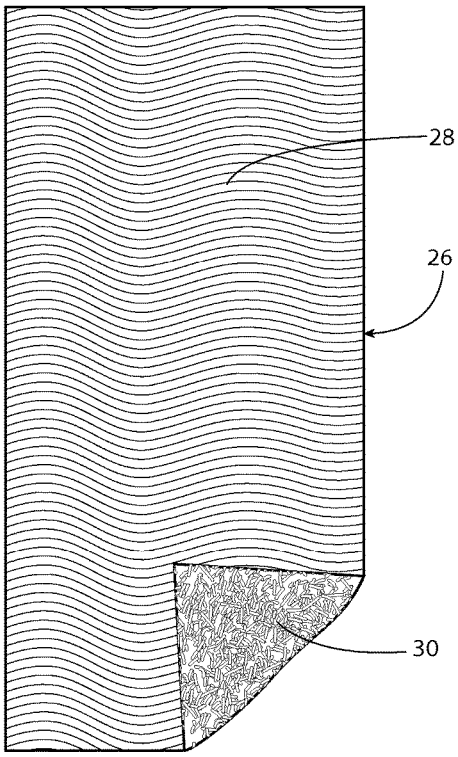
Figure 8B:
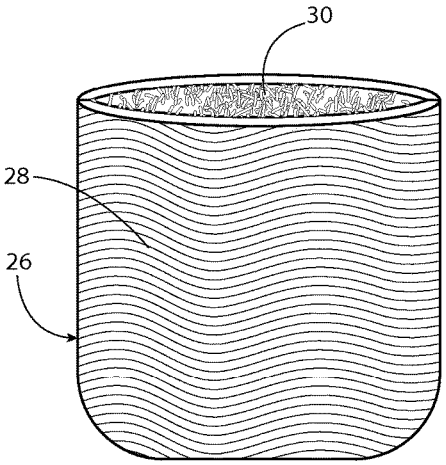
Figure 8C:
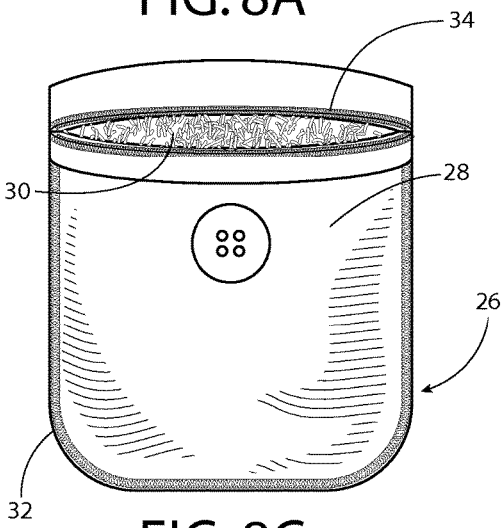
Figure 8D:
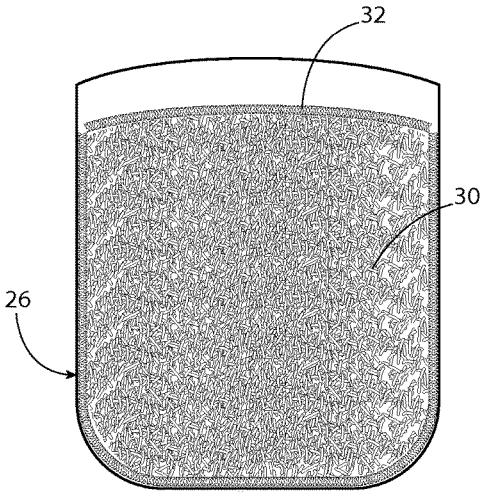

FIGS. 3A-3D show multiple views of a second preferred embodiment of the present invention which has an extended fabric sheet. FIG. 3A is a plan view of the extended fabric sheet with and without the insert card attached thereto. FIG. 3B is a plan view of the extended fabric sheet prior to folding and attachment to the insert card. FIG. 3C is a plan view of the back of the insert card with the folded extended fabric sheet attached thereto. FIG. 3D is a plan view of a pair of short pants as same would appear with the insert card situated in the right hand pocket and the folded fabric sheet situated outside the pocket;

FIG. 4 is a plan view of the front of the second preferred embodiment of the present invention with the folded extended fabric sheet partially raised such that a portion of the front of the insert card is visible;

FIG. 5 is a plan view of the front of the second preferred embodiment of the present invention with the folded extended fabric sheet hanging down over the front of the insert card;

FIG. 6 is a plan view of the front of the second preferred embodiment of the present invention with the folded extended fabric sheet hanging down over the front of the insert card and folded back to expose part of the front of the insert card;

FIG. 7 is a plan view of the back of the second preferred embodiment of the present invention;

FIGS. 8A-8D illustrate a third preferred embodiment of the present invention. FIG. 8A is a plan view of an extended fabric sheet with the lower right hand corner turned up to show that one side of the sheet has a relatively smooth surface and the other side has a relatively rough surface. FIG. 8B is a plan view the folded extended fabric sheet of FIG. 8A with side and bottom edges aligned. FIG. 8C shows a pocket formed of fabric sheet of FIG. 8B with the side and bottom edges sewn together to form a replacement pocket for the standard back pocked of a garment. FIG. 8D is a plan view of the pocket of FIG. 8C as it would appear with the fabric sheet pulled out such that the relatively rough surface of the fabric material is available for cleaning.

Figure 9A:
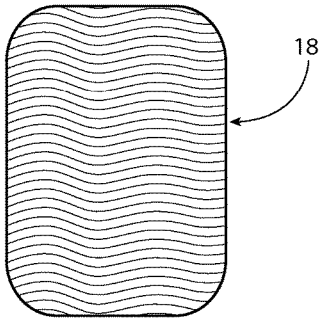
Figure 9B:
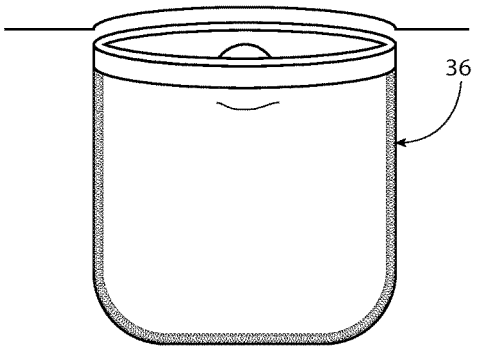
Figure 9C:
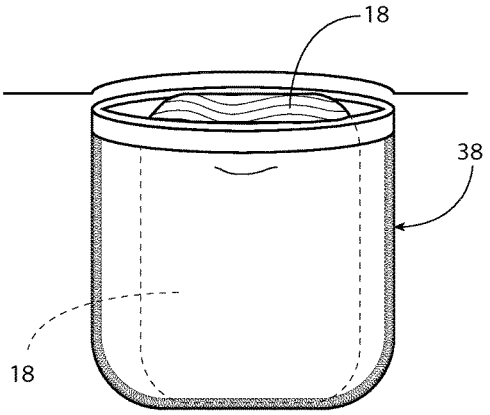
Figure 9D:
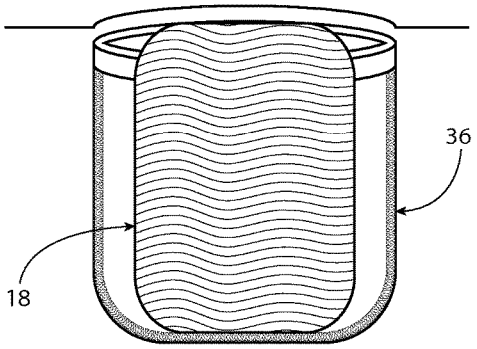
Figure 10:
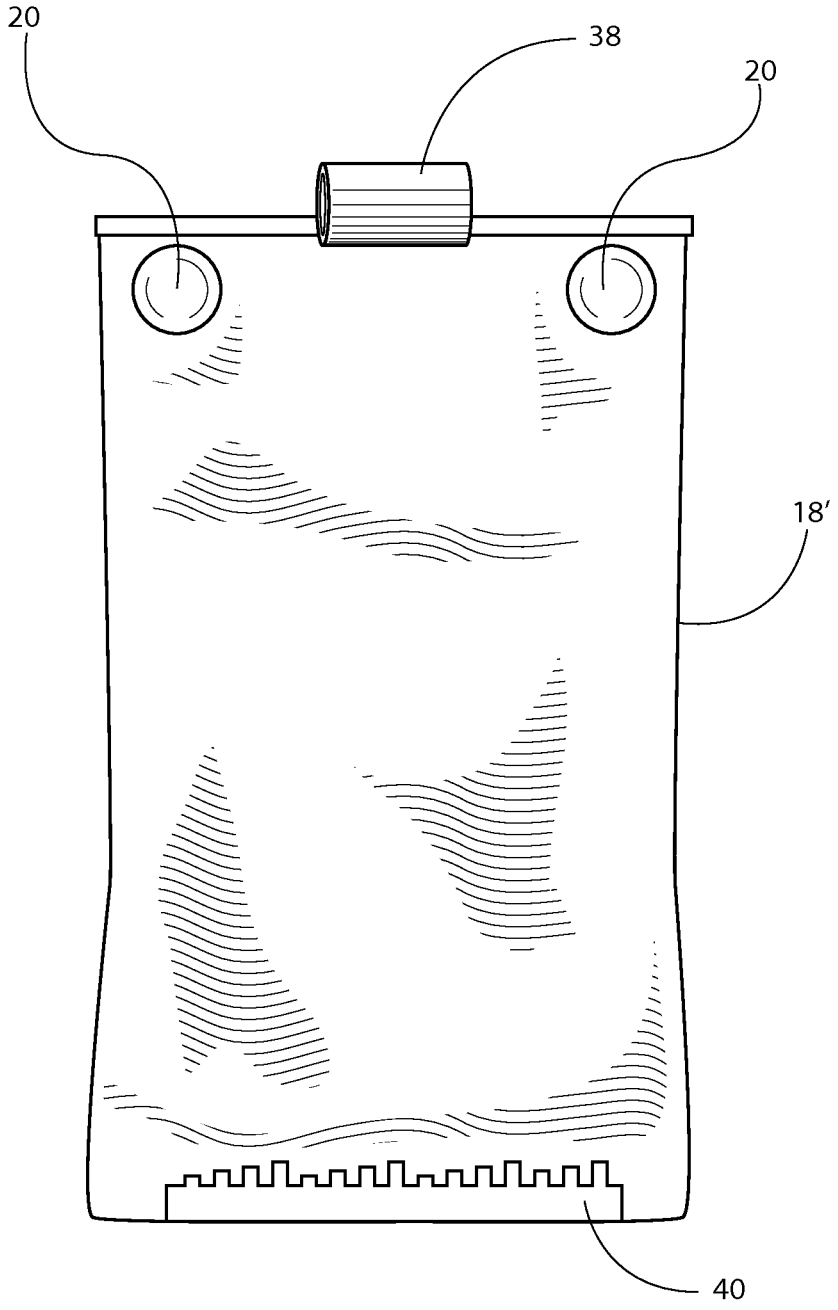
Figure 11:
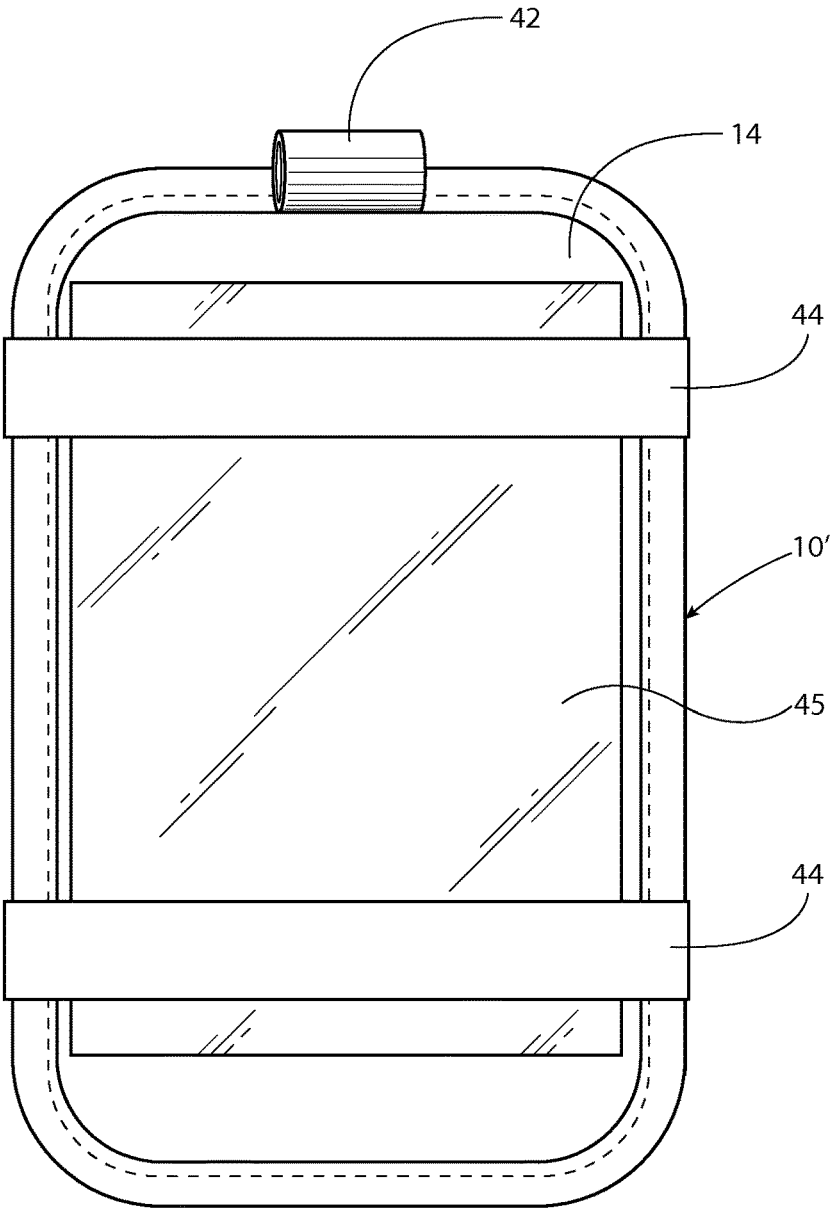
Figure 12:
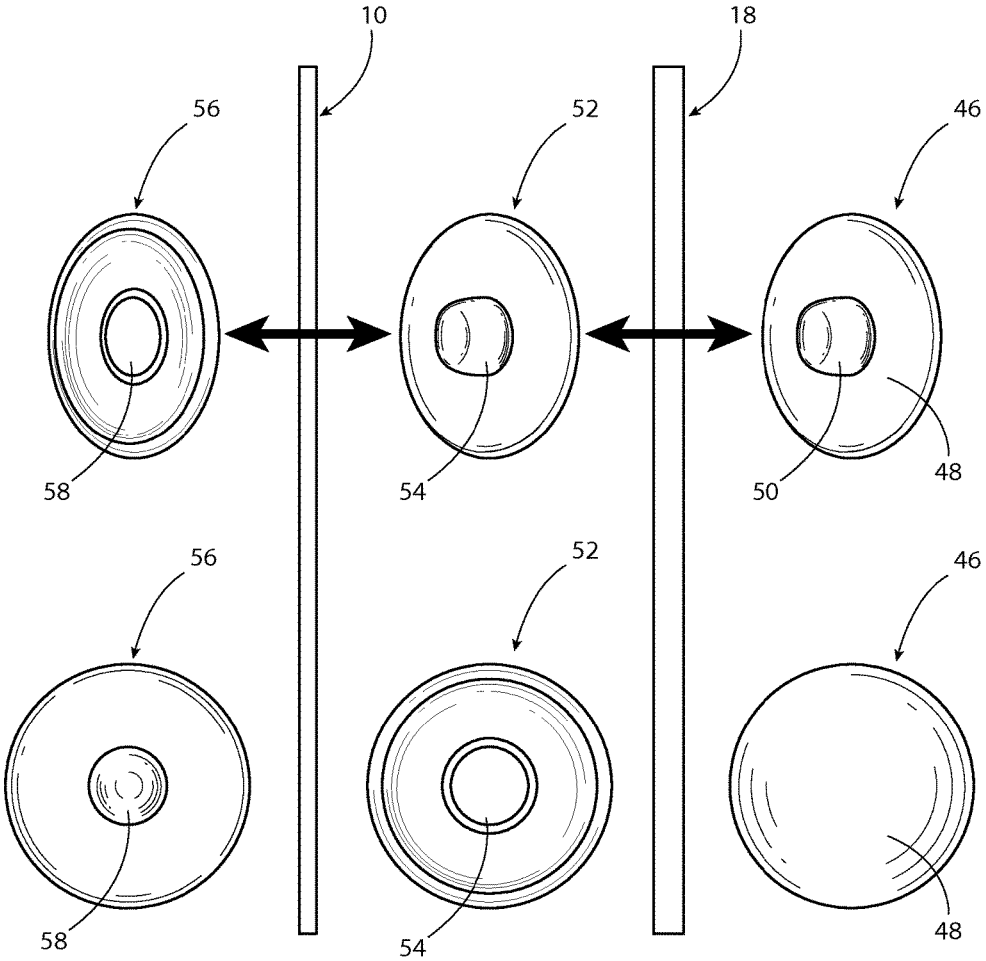

FIGS. 9A-9D illustrate a fourth preferred embodiment of the present invention. FIG. 9A is a plan view of a fabric sheet. FIG. 9B is a plan view of a conventional garment pocket. FIG. 9C shows the top of the fabric sheet of FIG. 9A attached to the rear of the opening of the pocket of FIG. 9B with the fabric sheet situated within the pocket. FIG. 9D is a plan view similar to that of FIG. 9C but with the fabric sheet situated outside of the pocket;

FIG. 10 is a plan view of an alternate version of the elongated fabric sheet with a tee or pencil holder and golf club groove cleaner mounted thereon;

FIG. 11 is a plan view of an alternate version of the pocket insert card with a tee or pencil holder and a score card holder;

FIG. 12 is an exploded perspective view of the components of a double sided snap which may be used to secure a ball marker and a plan view of the rear of such components; and FIG. 13A-13D are plan views of the front and rear of a pair of shorts with an absorbent sheet situated inside and outside the clothing.

DETAILED DESCRIPTION OF THE INVENTION

Figure 1:
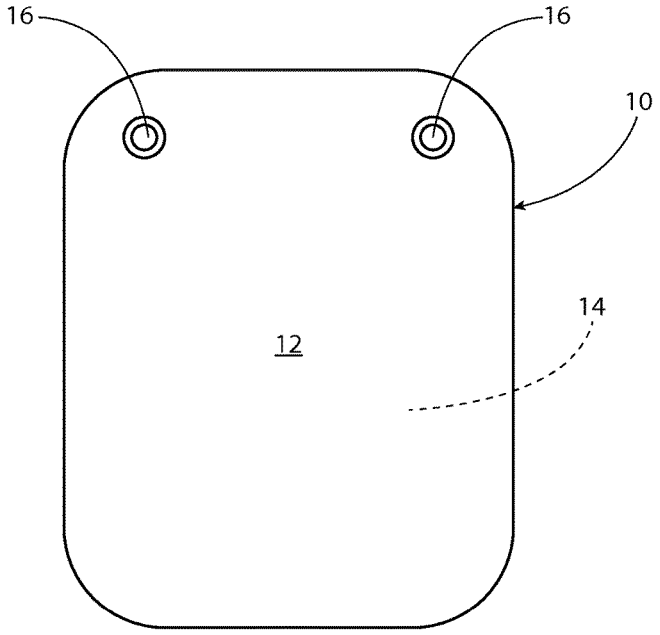
FIG. 1 is a plan view of the back of a pocket insert card with fasteners in the form of button snaps.
Figure 2:
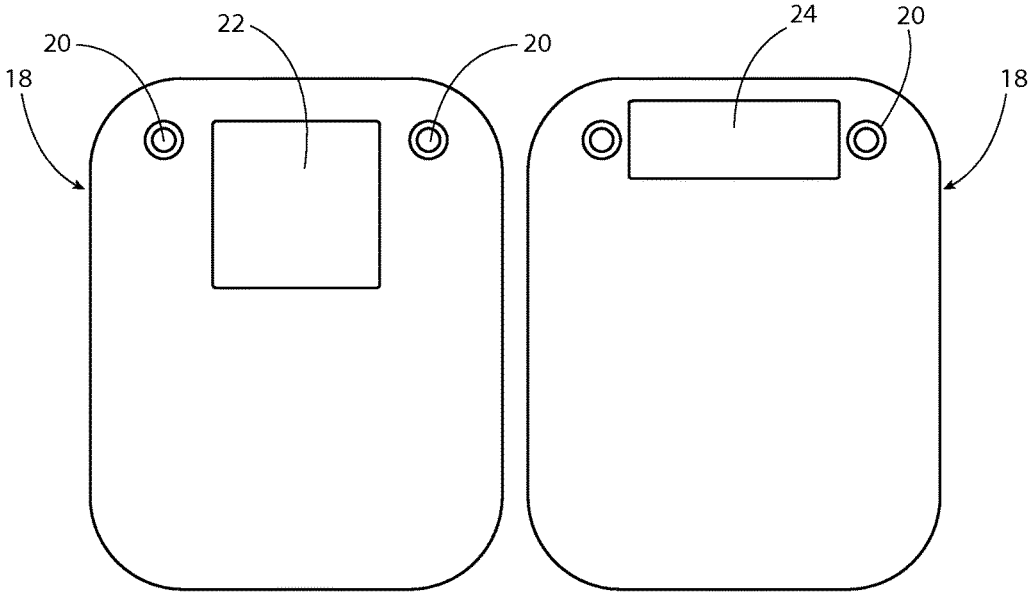
FIG. 2 is a plan view of two versions of the front a fabric sheet with fasteners in the form of button snaps for attaching to the insert card of FIG. 1 to form a first preferred embodiment of the present invention, the fabric sheets having square and rectangular shaped hook and loop ribbon sections on the front thereof, respectively.

The present invention can be provided in a number of different preferred embodiments. One preferred embodiment is illustrated in FIGS. 1 and 2. Those figures illustrate the most basic form of the invention which includes two parts. One of the parts is made of an absorbent fabric sheet used as a towel for cleaning the hands of the user or equipment in the possession of the user. The other part is used to anchor the fabric part on the clothes of the user, and more specifically, to be received in a pocket of a garment worn by the user.

As seen in FIG. 1, the anchor part takes the form of a pocket insert card, generally designated as 10, having a front surface 12 and a back surface 14. Card 10 is intended to be situated within the back or front pocket of a garment such as a pair of pants, a skirt or a jacket. Card 10 may be made of any suitable material, such as thick paper, cardboard or plastic which is rigid enough to be securely received in a pocket and strong enough to support the cleaning part, and at the same time be light in weight, somewhat flexible and inexpensive.

Card 10 preferably has rounded corners. The rounded corners allow the card to be easily inserted into and withdrawn from a standard pocket.

Card 10 also includes at least two fasteners 16 spaced from each other along the upper portion of the card. Fasteners 16 may permanently attach the fabric part to the card. However, it is preferable to utilize a detachable fastener for this purpose, such as button snaps 16 as illustrated or any other simple fastening device which can be used to easily attach and detach an object to the card.

FIG. 2 illustrates two versions a fabric sheet or towel, generally designated 18. Sheet 18 is preferably made of cotton, microfiber polyester or any other flexible, cloth-like absorbent material.

Sheet 18 includes at least two fasteners 20 configured and situated to mate with fasteners 16 of card 10. Fasteners 20 connect sheet 18 and card 10. Preferably, the fasteners allow sheet 18 to be detachably connected to the card.

Sheet 18 is intended to be situated outside the garment of the user when the card is placed in the pocket of the user. In this manner, the fabric sheet is accessible such that it can be used to wipe the hands or to clean equipment such as a golf club or golf ball.

As seen in FIG. 2, the front surface of sheet 18 may be provided with different shaped patches of hook and loop fastener, such as is commonly sold under the brand name VELCRO®. The hook and loop fastener patch may be used to detachably retain golf gloves or any other object with a mating section of hook and loop strip to the card. While the fastening patch can be any size and shape, the left figure of FIG. 2 illustrates the patch as being a square fastening patch 22, wherein the right figure illustrates a rectangular fastening patch 24.

Another preferred embodiment is illustrated in FIGS. 3-7. This preferred embodiment is essentially the same as the first preferred embodiment except that it employs a fabric sheet 18' which is elongated lengthwise as compared to sheet 18 of the embodiment of FIG. 2.

FIGS. 3A-3D show multiple views of the elongated sheet embodiment. FIG. 3A shows the unfolded elongated fabric sheet 18' attached to the front 12 of the card. FIG. 3B shows the elongated fabric sheet prior to folding along horizontal fold line 19. FIG. 3C shows the back 14 of the assembly of the insert card and attached folded elongated fabric sheet 18'. FIG. 3D shows a pair of short pants as same would appear with the insert card 10 situated in the right hand rear pocket and the folded fabric sheet 18' situated outside the pocket of the garment.

FIG. 4 shows the card/sheet assembly with the bottom portion of the folded elongated fabric sheet 18' partially raised such that a portion of the front 12 of the insert card is visible. FIG. 5 shows the card/sheet assembly of FIG. 4 with the folded elongated fabric sheet 18' hanging down over the front 12 of the insert card. FIG. 6 shows the assembly of FIG. 5 with the folded elongated fabric sheet 18' hanging down over the front 12 of the insert card, one of the snaps unfastened and the sheet folded back along a vertical line to expose part of the front 12 of the insert card. FIG. 7 shows the back 14 of the card/sheet assembly of FIG. 5.

FIGS. 8A-8D illustrate another preferred embodiment of the present invention. In this embodiment, the insert card is not used. Instead, the fabric sheet itself is used to form the pocket of the garment. The fabric sheet pocket is pulled out from the garment interior and situated outside the garment for cleaning while the rim or mouth of the fabric sheet pocket remains attached to the garment.

FIG. 8A shows an elongated fabric sheet 26 having a relatively smooth fabric side 28 and a relatively rough fabric side 30. The figure shows the lower right hand corner of sheet 26 turned up to show a portion of the relatively rough side 30. FIG. 8B shows the folded elongated fabric sheet of FIG. 8A with sides and bottom edges aligned. FIG. 8C shows the pocket formed by folded fabric sheet of FIG. 8B with the side edges and bottom edges sewn together by stitch line 32 to form a pocket. The is then sewn into the garment along the rim by stitch line 34 to form the back pocket of a garment. FIG. 8D shows the pocket of FIG. 8C as it would appear with the fabric sheet 26 pulled out of the garment and such that the relatively rough fabric side 30 of the fabric sheet is available for cleaning;

A preferred embodiment of the present invention is illustrated in FIGS. 9A-9D. In this embodiment, like the embodiment of FIGS. 8A-8D, no insert card is used. Instead, the fabric sheet 18, such as those shown in FIG. 2, is stitched directly to the lining of a conventional garment pocket. Sheet 18 is permanently attached to the pocket lining. It remains in the pocket when not in use. However, the fabric sheet can be moved to a position outside of the garment for cleaning purposes.

FIG. 9A shows the unattached fabric sheet 18. The fabric sheet is similar to that shown in FIG. 2, but has no fasteners and no hook and loop patch. FIG. 9B shows a conventional garment pocket 36. FIG. 9C shows the top of the fabric sheet 18 attached to the lining of pocket 36 proximate the open mouth or the rim of the pocket. The sheet may be attached to the pocket lining by the same stitching that attaches the mouth or rim of the pocket to the garment. The fabric sheet is shown situated within the pocket in this figure. In FIG. 9D, the fabric sheet 18 situated outside of and draped over pocket 36 such that it is ready for use.

FIG. 10 shows an alternate version of the elongated fabric sheet 18' with a golf tee/pencil holder 38 and golf club groove cleaner 40 mounted thereon. The golf tee/pencil holder 38 takes the form of a strip fabric with the ends sewn to each other and to the fabric sheet to form a cylindrical channel adapted to retain a spare golf tee or a pencil. Since it is customary to keep the score of a golf game using a scorecard and a pencil, it is handy to have a pencil in an easily accessible location. Similarly, it is useful to have a spare golf tee readily available.

This version of the fabric sheet 18' also carries a rigid PVC strip 40 attached to the lower portion of the sheet. The strip is configured into a golf club groove cleaner.

FIG. 11 shows an alternate version of the pocket insert card 10'. This version of the pocket insert card has a spare golf tee/pencil holder 42 similar to holder 40. Further, it has spaced elastic strips 44 across the back 14 of the card intended to be used to retain a scorecard (not shown) behind a clear plastic sheet 45.

The top portion of FIG. 12 shows an exploded perspective view of the male and female parts of double sided snap which may be substituted for snap 20 to fasten a fabric sheet to a pocket insert card and at the same time to detachably mount a ball marker or other object to the double sided snap. The bottom portion of the figure shows front plan view of each of the snap parts and the ball marker.

As seen in the figure, ball marker 46 consists of a circular marker portion 48 with a protruding central portion 50 at the rear. The double sided snap includes a male portion 52 and a female portion 56.

The rear surface of male portion 52 of the double sided snap has a hollow protrusion 54 which is open in the front. To secure the double sided snap to card 10, portion 54 of male part 52 is received through an opening in the card and lodges in opening 58 of female part 56, situated on the other side of the card. To mount ball marker 46 to male part 52, protrusion 50 of the ball marker is received in protrusion 54 of male part 52.

The ball marker 46 can also be used to mount the fabric sheet 18 to card 10. Before mounting the ball marker on male part 52, protrusion 50 is inserted through a hole in the fabric sheet. Protrusion 50 is then received in protrusion 54 of the male part 52, securing the fabric sheet to the card.

A similar ball marker, double sided snap arrangement could be used on other objects which have a snap, such as a golf glove. The conventional snap provided to maintain the glove tight around the user's wrist would be replaced with the male and female parts of the double sided snap, which would then allow the ball marker to be detachably mounted on the glove.

FIGS. 13A-13D illustrate another embodiment of the present invention. This embodiment is intended to be used by a person wearing clothing, such as a pair of shorts 60 having an elongated opening 62 into the interior of the clothing. Opening 62 would appear from the exterior of the garment like the opening for a pocket.

Figure 13A:
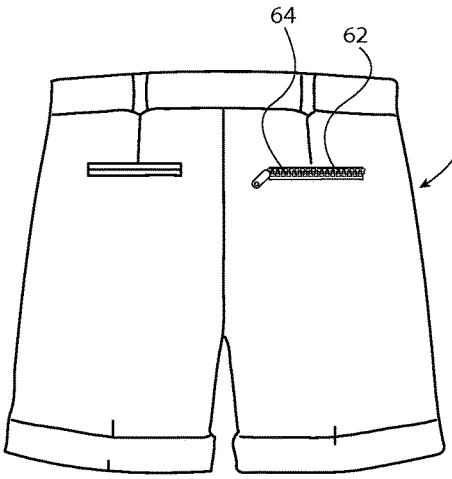
Figure 13B:
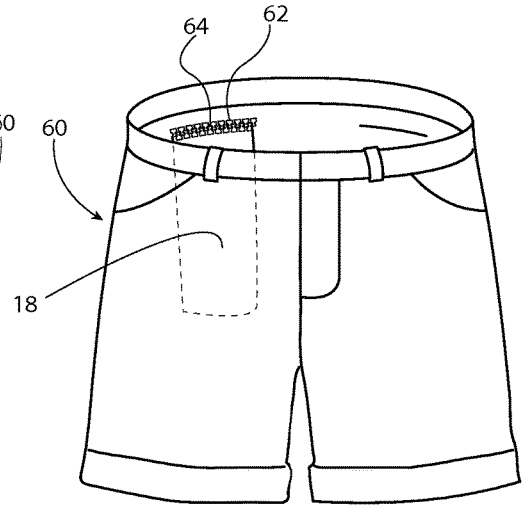

An absorbent fabric sheet 18 is normally situated within the interior of the clothing and is attached at the top to the interior of the clothing proximate opening 62. FIGS. 13A and 13B respectively show the rear and front of shorts 60 with the fabric sheet inside the garment. The absorbent fabric sheet is otherwise unattached to the clothing.

Figure 13C:
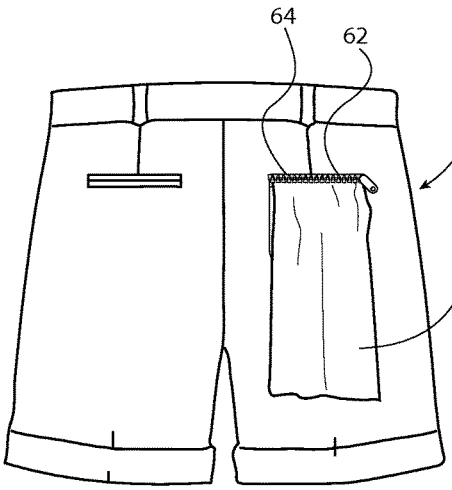
Figure 13D:
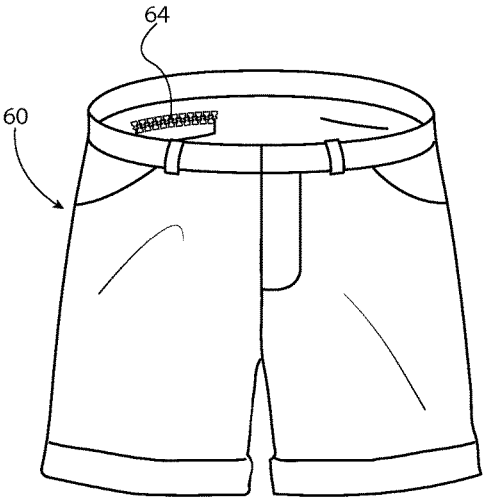

The person may move the unattached portion of the absorbent fabric sheet 18 through opening 62 to a position outside of the clothing for use in cleaning the person's hands or golf equipment. FIGS. 13C and 13D respectively show the exterior of shorts 60 from the rear and front with the fabric sheet situated outside the garment and ready for use. A zipper 64 may be provided to close opening 62 when the fabric sheet is not in use.

While only a limited number of preferred embodiments of the present invention have been disclosed for purposes of illustration, it is obvious that many modifications and variations could be made thereto. It is intended to cover all of those modifications and variations which fall within the scope of the present invention, as defined by the following claims.

We claim:

1. A golf accessory for use by a person wearing a garment including a pocket, the accessory comprising a member adapted to be received within the pocket, a fabric sheet of absorbent material, and means for attaching said fabric sheet and said member such that said fabric sheet is located outside of the pocket when the member is received in the pocket, further comprising means for attaching a ball marker to said attaching means.

2. A golf accessory for use by a person wearing a garment including a pocket, the accessory comprising a member adapted to be received within the pocket, a towel comprising a first towel section having first and second sides and an end portion, a second towel section having first and second sides and an end portion, and an intermediate section between said first towel section and said second towel section, said towel being folded along said intermediate section such that said end portion of said first towel section and said end portion of said second towel portion are situated in face-to-face relation, a fastener attaching said end portion of said first towel section and said end portion of said second towel section to said member without attaching said sides of said first towel section and said second towel section together.

3. The accessory of claim 2 wherein said member comprises a generally planar body with at least one rounder corner.

4. The accessory of claim 2 wherein said first and second sections of said fabric sheet are folded in face-to-face relation.

5. The accessory of claim 2 wherein said fastener comprises a device including at least one of a snap, a button, and a hook and loop material strip.

6. The accessory of claim 2 wherein said towel has a generally rectangular shape.

7. The accessory of claim 2 wherein said towel comprises at least one of cotton, microfiber and polyester.

8. The accessory of claim 2 wherein member comprises a pocket insert card.

9. The accessory of claim 2 further comprising means for removeably attaching a golf glove to said towel.

10. The accessory of claim 2 wherein said towel is elongated.

11. The accessory of claim 2 wherein said fastener permanently connects said end portion of said first towel section and said end portion of said second towel section to said member.

12. The accessory of claim 2 wherein said fastener detachably connects said end portion of said first towel section and said end portion of said second towel section to said member.

13. The accessory of claim 12 wherein said fastener comprises a first part, a second part and a third part wherein said member is situated between said first fastener part and said second fastener part and wherein said end portion of at least one towel section is situated between said second fastener part and said third fastener part.

14. The accessory of claim 13 wherein said first fastener part comprises an opening, said second fastener part comprises a hollow protrusion adapted to be received in said first part opening and said third fastener part comprises a protrusion adapted to be received within said hollow protrusion of said second part.

15. The accessory of claim 13 wherein said third fastener part is a ball marker.

16. The accessory of claim 2 further comprising a second fastener attaching said end portion of said first towel section and said end portion of said second towel section to said member without attaching said sides of said first towel section and said second towel section together.

* * * * *